US010583955B2

(12) United States Patent
Ackroyd et al.

(10) Patent No.: US 10,583,955 B2
(45) Date of Patent: Mar. 10, 2020

(54) PACKAGE INCLUDING CARTON WITH INSERT

(71) Applicant: Graphic Packaging International, Inc., Atlanta, GA (US)

(72) Inventors: Robert Ackroyd, Leeds (GB); Harmen Boersma, Heerenveen (NL)

(73) Assignee: Graphic Packaging International, LLC, Atlanta, GA (US)

( * ) Notice: Subject to any disclaimer, the term of this patent is extended or adjusted under 35 U.S.C. 154(b) by 30 days.

(21) Appl. No.: 15/609,429

(22) Filed: May 31, 2017

(65) Prior Publication Data

US 2017/0349320 A1 Dec. 7, 2017

Related U.S. Application Data

(60) Provisional application No. 62/345,355, filed on Jun. 3, 2016.

(51) Int. Cl.
*B65D 5/44* (2006.01)
*B65D 5/10* (2006.01)
(Continued)

(52) U.S. Cl.
CPC ..... *B65D 5/445* (2013.01); *B65D 5/0227* (2013.01); *B65D 5/10* (2013.01); *B65D 5/103* (2013.01); *B65D 5/4266* (2013.01); *B65D 5/66* (2013.01)

(58) Field of Classification Search
CPC ..... B65D 5/445; B65D 5/0227; B65D 5/10; B65D 5/103; B65D 5/4266; B65D 5/66;
(Continued)

(56) References Cited

U.S. PATENT DOCUMENTS 499,655 A * 6/1893 Clark ..... B65D 5/566 229/122.34
504,551 A 9/1893 Brandstaedter
(Continued)

FOREIGN PATENT DOCUMENTS

DE 2 320 190 11/1973
DE 36 27 019 2/1988
(Continued)

OTHER PUBLICATIONS

International Search Report and Written Opinion for PCT/US2017/035120 dated Aug. 18, 2017.
(Continued)

*Primary Examiner* — Christopher R Demeree
(74) *Attorney, Agent, or Firm* — Womble Bond Dickinson (US) LLP

(57) ABSTRACT

A package for holding at least one product includes a carton and at least one insert. The carton includes a plurality of panels extending at least partially around an interior of the carton to form at least one corner of the carton. The at least one insert is at least partially disposed in the interior of the carton adjacent the at least one corner to reinforce the carton, and includes a first panel, a second panel, and an intermediate portion between the first panel and the second panel. Each of the first panel and the second panel is attached to a respective panel of the plurality of panels and the intermediate portion is free from attachment to the plurality of panels.

38 Claims, 11 Drawing Sheets

(51) Int. Cl.
*B65D 5/42* (2006.01)
*B65D 5/66* (2006.01)
*B65D 5/02* (2006.01)

(58) Field of Classification Search
CPC ..... B65D 5/001; B65D 5/44; B65D 2571/00814; B31B 2105/00; B65B 43/265
USPC ..... 229/199, 122.32, 918, 915, 919, 191; 493/168, 379, 89, 907, 94, 96; 206/586, 206/176; 220/651, 652, 653
See application file for complete search history.

(56) References Cited

U.S. PATENT DOCUMENTS 516,983 A 3/1894 Beery
642,121 A 1/1900 Hildreth
698,106 A 4/1902 Dalsheimer
997,263 A 7/1911 Bird
1,503,161 A 7/1924 Hornecker
1,634,073 A * 6/1927 Labombarde ..... B65D 5/445 229/126
1,656,919 A 1/1928 Marsh
1,762,704 A 6/1930 Smith
1,782,611 A 11/1930 Hackett et al.
1,784,317 A * 12/1930 Stokes ..... B65D 65/22 229/164.1
1,821,692 A 9/1931 Copeland
1,901,483 A 3/1933 Ware, Jr.
1,912,698 A 6/1933 Forsman
1,925,102 A 9/1933 Levkoff
1,951,408 A 3/1934 Haven
1,971,863 A * 8/1934 Lupton ..... B65D 5/326 206/176
2,027,079 A 1/1936 Weiss
2,141,743 A 12/1938 Ethridge
2,145,430 A 1/1939 New
2,152,079 A 3/1939 Mott
2,196,243 A 4/1940 Bensel
2,290,971 A 7/1942 King
2,330,294 A * 9/1943 Leavitt ..... B65D 5/566 229/122.32
2,383,853 A 8/1945 Guyer
2,407,802 A 9/1946 Stotter
2,416,332 A 2/1947 Sylvester
2,502,117 A 3/1950 Anderson
2,643,589 A * 6/1953 Weiss ..... B65D 5/0227 493/128
2,679,349 A 5/1954 Mullinix
2,710,134 A * 6/1955 Schroeder ..... B65D 5/566 105/423
2,791,362 A 5/1957 Nute
2,862,425 A 12/1958 Swaim et al.
2,875,938 A 3/1959 Bramhill
2,933,228 A 4/1960 Guyer
2,954,913 A * 10/1960 Rossman ..... B65D 81/386 220/560.15
2,967,610 A 1/1961 Ebert
3,002,613 A 10/1961 Merkel et al.
3,090,483 A 5/1963 Altree et al.
3,092,301 A 6/1963 Selle
3,094,266 A 6/1963 Hoff
3,126,144 A 3/1964 McCulloch
3,157,342 A 11/1964 Grady
3,158,312 A 11/1964 Simkins
3,199,763 A 8/1965 Anderson
3,265,283 A 8/1966 Farquhar
3,276,665 A 10/1966 Rasmussen
3,280,968 A 10/1966 Craine
3,434,648 A 3/1969 Du Barry, Jr.
3,648,920 A * 3/1972 Stump ..... B65D 5/5033 138/177
3,653,495 A 4/1972 Gray
3,677,458 A 7/1972 Gosling
3,759,378 A 9/1973 Werth
3,786,914 A 1/1974 Beutler
3,878,771 A 4/1975 Malcolm
3,884,348 A 5/1975 Ross
4,008,849 A 2/1977 Baber
4,059,220 A 11/1977 Lorenz
4,113,100 A 9/1978 Soja et al.
4,519,538 A 5/1985 Omichi
4,558,785 A 12/1985 Gordon
4,586,643 A 5/1986 Halabisky et al.
4,608,038 A 8/1986 Virta et al.
4,742,917 A 5/1988 Bornwasser
4,760,952 A 8/1988 Wachter et al.
4,773,541 A 9/1988 Riddell
4,778,057 A 10/1988 Allen et al.
4,815,609 A 3/1989 Kiedaisch
4,865,187 A 9/1989 Zulauf et al.
4,886,160 A 12/1989 Kilgerman
4,919,269 A 4/1990 Wright et al.
4,946,540 A 8/1990 Mitchard
5,012,929 A 5/1991 Roosa
5,097,651 A 3/1992 Decottignies et al.
5,129,875 A 7/1992 Chaygneaud-Dupuy
5,163,891 A 11/1992 Goldsborough et al.
5,181,650 A 1/1993 Hollander et al.
5,211,618 A 5/1993 Stoltz
5,222,660 A 6/1993 Koss
5,328,091 A 7/1994 Koss
5,699,957 A 12/1997 Blin et al.
5,746,871 A 5/1998 Walsh
5,783,030 A 7/1998 Walsh
5,794,812 A 8/1998 Walsh
5,842,576 A 12/1998 Snow
5,857,570 A 1/1999 Brown
5,881,884 A 3/1999 Podosek
D412,114 S 7/1999 Hansen
5,921,398 A 7/1999 Carroll
5,927,498 A 7/1999 Saam
5,979,749 A 11/1999 Bozich
D419,440 S 1/2000 Hansen
6,015,084 A 1/2000 Mathieu et al.
6,027,017 A 2/2000 Kuhn et al.
6,129,211 A 10/2000 Prakken et al.
6,135,289 A 10/2000 Miller
6,158,579 A 12/2000 Rosenbaum
6,386,369 B2 5/2002 Yuhas et al.
6,419,152 B1 7/2002 Tokarski
6,435,351 B1 8/2002 Gibb
6,478,159 B1 11/2002 Taylor et al.
6,510,982 B2 1/2003 White
6,523,692 B2 2/2003 Gregory
6,729,475 B2 5/2004 Yuhas et al.
6,854,639 B2 2/2005 Walsh
6,869,009 B2 3/2005 Sutherland et al.
6,905,027 B2 6/2005 Gaiter
6,913,189 B2 7/2005 Oliff et al.
6,918,487 B2 7/2005 Harrelson
7,021,468 B2 4/2006 Cargile, Jr.
7,201,714 B2 4/2007 Zoeckler et al.
8,622,280 B2 1/2014 Coltri-Johnson et al.
8,827,144 B2 9/2014 Gomes et al.
9,260,215 B2 2/2016 Coltri-Johnson et al.
9,630,736 B2 4/2017 Oliveira
2001/0048022 A1 12/2001 Zoeckler
2002/0170845 A1 11/2002 Oliff
2003/0226879 A1 12/2003 Auclair et al.
2005/0092649 A1 5/2005 Ford et al.
2005/0167291 A1 8/2005 Sutherland
2005/0189251 A1 9/2005 Bringard et al.
2005/0218203 A1 10/2005 Harrelson
2006/0266815 A1 11/2006 Coltri-Johnson et al.
2013/0153449 A1 6/2013 Agirbas

FOREIGN PATENT DOCUMENTS

DE 298 17 195 11/1998
DE 202 16 854 1/2003
EP 0 133 595 2/1985
EP 0 704 386 4/1996
EP 1 415 924 5/2004

(56) References Cited

FOREIGN PATENT DOCUMENTS

| | | | |
|---|---|---|---|
| FR | 1.379.931 | | 12/1963 |
| FR | 2 882 032 | | 8/2006 |
| GB | 1 218 016 | | 1/1971 |
| JP | 2012-131521 | A | 7/2012 |
| JP | 2013-023235 | A | 2/2013 |
| JP | 2013-252895 | A | 12/2013 |
| JP | 2015-016889 | A | 1/2015 |
| WO | WO 98/31593 | | 7/1998 |
| WO | WO 03/082686 | | 10/2003 |
| WO | WO 2004/063031 | | 7/2004 |

OTHER PUBLICATIONS

Supplementary European Search Report for EP 17 80 7371 dated Nov. 27, 2019.

* cited by examiner

PACKAGE INCLUDING CARTON WITH INSERT

CROSS-REFERENCE TO RELATED APPLICATION

This application claims the benefit of U.S. Provisional Patent Application No. 62/345,355, filed on Jun. 3, 2016.

INCORPORATION BY REFERENCE

The disclosure of U.S. Provisional Patent Application No. 62/345,355, filed on Jun. 3, 2016, is hereby incorporated by reference for all purposes as if presented herein in its entirety.

BACKGROUND OF THE DISCLOSURE

The present disclosure generally relates to packages with cartons having at least one insert.

SUMMARY OF THE DISCLOSURE

According to one aspect of the disclosure, a package for holding at least one product comprises a carton and at least one insert. The carton comprises a plurality of panels extending at least partially around an interior of the carton to form at least one corner of the carton. The at least one insert is at least partially disposed in the interior of the carton adjacent the at least one corner to reinforce the carton, and comprises a first panel, a second panel, and an intermediate portion between the first panel and the second panel. Each of the first panel and the second panel is attached to a respective panel of the plurality of panels and the intermediate portion is free from attachment to the plurality of panels.

According to another aspect of the disclosure, a combination comprises a carton blank and at least one insert blank for forming a package for holding at least one product. The carton blank is for forming a carton and comprises a plurality of panels for extending at least partially around an interior of the carton. The plurality of panels is for forming at least one corner of the carton when the carton is formed from the carton blank. The at least one insert blank is for forming at least one insert for being at least partially disposed in the interior of the carton adjacent the at least one corner to reinforce the carton when the package is formed. The at least one insert blank comprises a first panel, a second panel, and an intermediate portion between the first panel and the second panel, each of the first panel and the second panel is for being attached to a respective panel of the plurality of panels and the intermediate portion is for being free from attachment to the plurality of panels when the package is formed.

According to another aspect of the disclosure, a method of forming a package from a carton blank and at least one insert blank comprises obtaining a carton blank, obtaining at least one insert blank, forming the at least one insert, forming the carton, and disposing the at least one insert at least partially in the interior of the carton. The carton blank comprises a plurality of panels. The at least one insert blank comprises a first panel, a second panel, and an intermediate portion between the first panel and the second panel. The at least one insert is formed by attaching the at least one insert blank to the carton blank. The carton is formed by folding the plurality of panels of the carton blank to extend at least partially around an interior of the carton and forming at least one corner of the carton. The at least one insert is at least partially disposed in the interior of the carton adjacent the at least one corner such that each of the first panel and the second panel is attached to a respective panel of the plurality of panels and the intermediate portion is free from attachment to the plurality of panels.

Those skilled in the art will appreciate the above stated advantages and other advantages and benefits of various additional embodiments reading the following detailed description of the embodiments with reference to the below-listed drawing figures.

According to common practice, the various features of the drawings discussed below are not necessarily drawn to scale. Dimensions of various features and elements in the drawings may be expanded or reduced to more clearly illustrate the embodiments of the disclosure.

BRIEF DESCRIPTION OF THE DRAWINGS

Corresponding parts may be designated by corresponding reference numbers throughout the drawings.

DETAILED DESCRIPTION OF THE EXEMPLARY EMBODIMENTS

The present disclosure generally relates to package including a carton that may contain products such as flowable materials or food products (e.g., cereal) or any other flowable material (e.g., powder-type mixes, granular materials, salts or other crystallines, detergents, etc.). The cartons described herein can include a liner or bag in the carton interior. The liner can be used to protect and store product in the carton. The liner can be made from materials suitable in composition for packaging the particular product, and the materials include, but are not limited to, plastics such as PET, LDPE, LLDPE, HDPE, PP, PS, PVC, EVOH, and Nylon; metals; papers; and the like, or any combination thereof. Alternatively, the liner can be omitted. In one or more embodiments, in this specification, the terms "inner," "interior," "outer," "exterior," "front," "back," "lower," "bottom," "upper" and "top" indicate orientations determined in relation to fully erected and upright packages and/or cartons.

Figure 1:
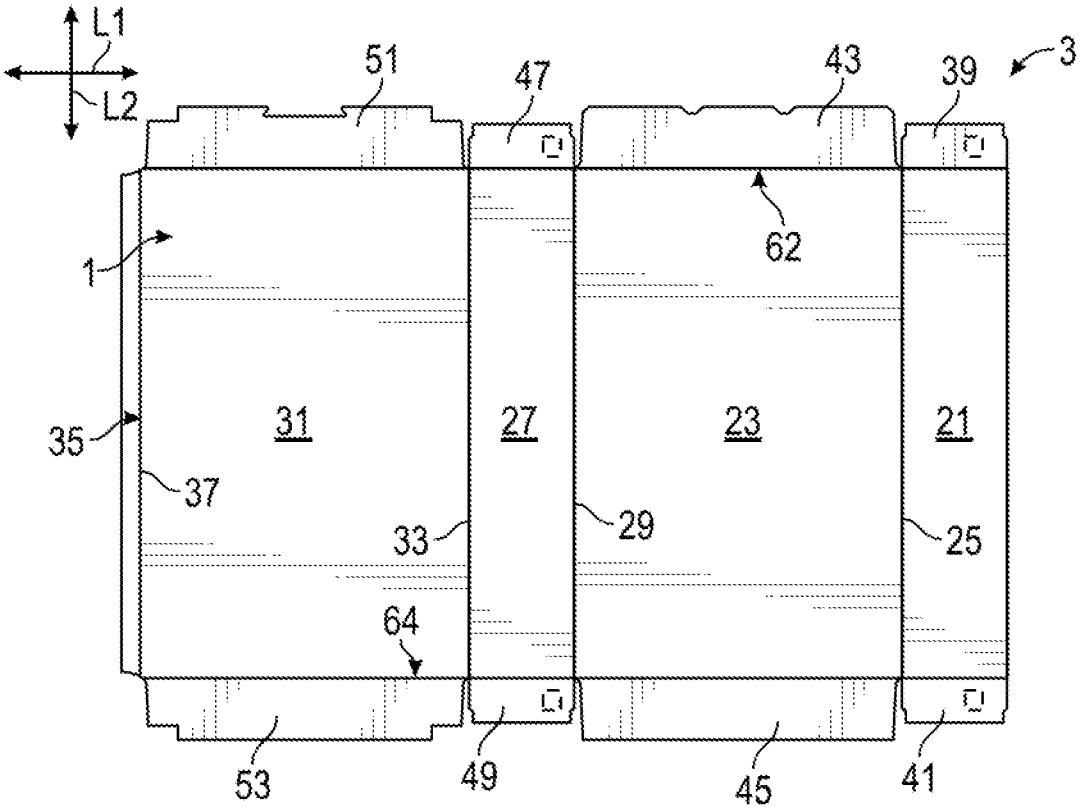
FIG. 1 is a plan view of a blank for forming a carton according to exemplary embodiments of the disclosure.
Figure 4:
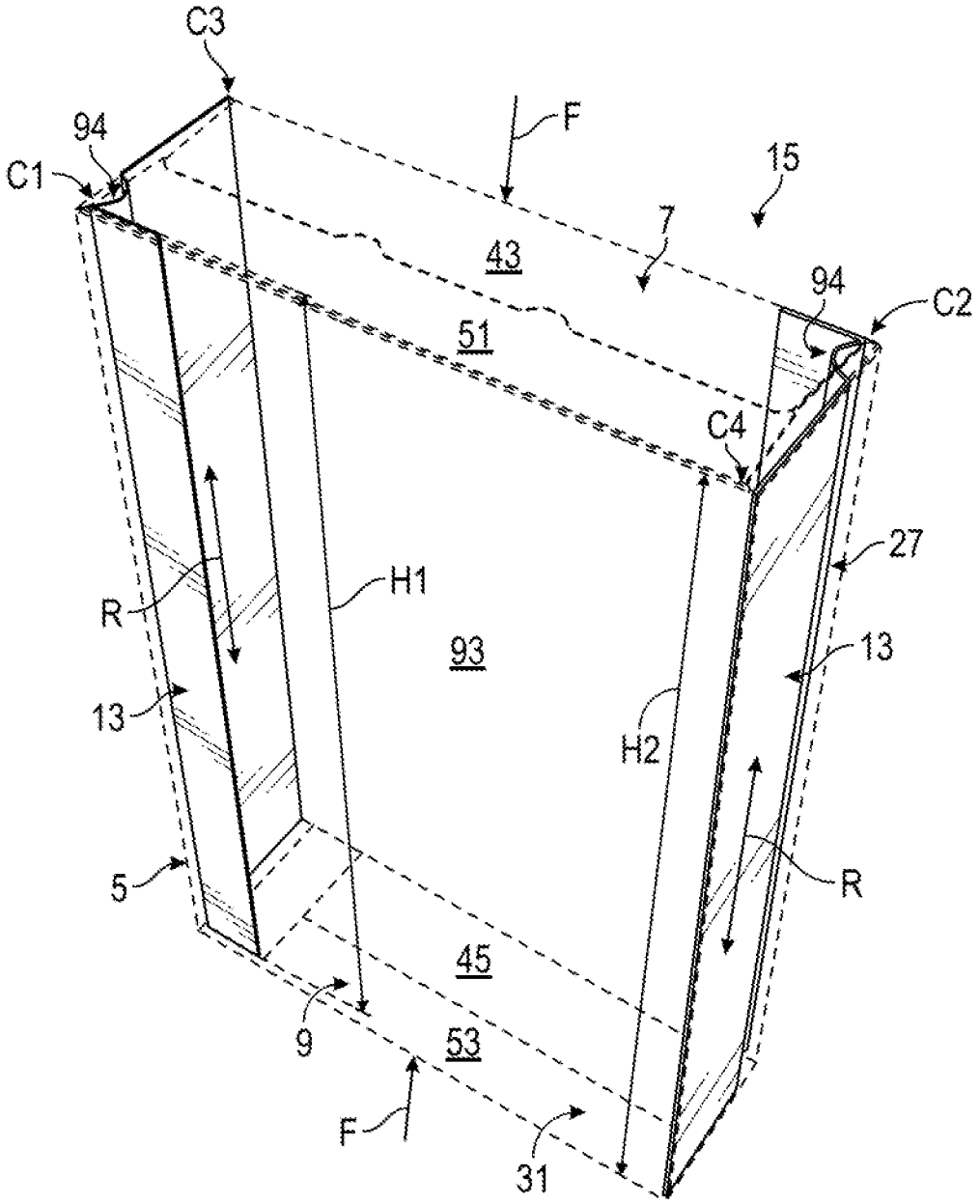
FIG. 4 is a perspective view, shown partially in hidden lines, of the package according to the first exemplary embodiment of the disclosure.

FIG. 1 is a plan view of the exterior side 1 of a blank, generally indicated at 3, used to form a carton 5 (FIG. 4) according to exemplary embodiments of the disclosure. The carton 5 can be used to house a flowable material (e.g., a food product such as cereal; not shown) or other products. The carton 5 can have a top closed end 7 and a bottom closed end 9 (FIG. 4). Two inserts 13 (FIG. 2) can be disposed within the carton 5 to form a package 15 (FIG. 4). The package 15 can also include a liner or bag (not shown) disposed within the carton 5.

As shown in FIG. 1, the blank 3 has a longitudinal axis L1 and a lateral axis L2. In the illustrated embodiment, the blank 3 includes a first end panel 21 foldably connected to a first side panel 23 at a first lateral fold line 25, a second end panel 27 foldably connected to the first side panel 23 at a second lateral fold line 29, and a second side panel 31 foldably connected to the second end panel 27 at a third lateral fold line 33. In the illustrated embodiment, the blank 3 includes an attachment flap 35 foldably connected to the second side panel 31 at a fourth lateral fold line 37. Alternatively, the attachment flap 35 could be foldably connected to the first end panel 21 or could be omitted without departing from the disclosure.

In the illustrated embodiment, a first end top flap 39 and a first end bottom flap 41 are foldably connected to the first end panel 21. As shown, a first side top flap 43 and a first side bottom flap 45 are foldably connected to the first side panel 23. A second end top flap 47 and a second end bottom flap 49 are foldably connected to the second end panel 27, as shown. A second side top flap 51 and a second side bottom flap 53 are foldably connected to the second side panel 31. The top flaps 39, 43, 47, and 51 extend along a first or top marginal area of the blank 3. The first end top flap 39 is foldably connected to the first end panel 21, the first side top flap 43 is foldably connected to the first side panel 23, the second end top flap 47 is foldably connected to the second end panel 27, and the second side top flap 51 is foldably connected to the second side panel 31 along a first longitudinal extending fold line 62 that extends along the length of the blank 3. The bottom flaps 41, 45, 49, 53 extend along a second or bottom marginal area of the blank 3. The bottom flaps 41, 45, 49, 53 are foldably connected to the respective panels 21, 23, 27, 31 along a second longitudinally extending fold line 64 that extends along the length of the blank 3. In one embodiment, the longitudinal fold lines 62, 64 may be, for example, substantially straight, or offset at one or more locations to account for the thickness of the blank 3 or for other factors. When the carton 5 (FIG. 4) is erected, the top end flaps 39, 43, 47, 51 can at least partially close the top end 7 of the carton 5, and the bottom end flaps 41, 45, 49, 53 can at least partially close the bottom end 9 of the carton 5. The blank 3 could be otherwise shaped, arranged, positioned, and/or configured, without departing from the disclosure.

Figure 2:
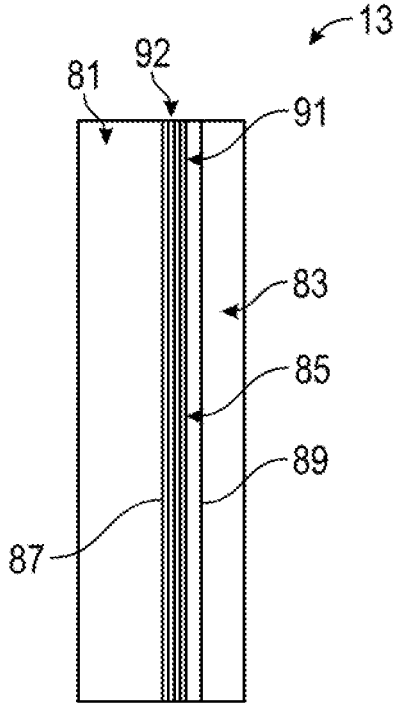
FIG. 2 is a plan view of an insert for being disposed in the carton formed from the blank of FIG. 1 to form a package according to a first exemplary embodiment of the disclosure.

FIG. 2 illustrates the insert 13 for use in the carton 5 (FIG. 4) according to the first exemplary embodiment of the disclosure. In the illustrated embodiment, two of the inserts 13 are provided for assembly with the carton 5, as described herein. The insert 13 can be formed from any suitable material (e.g., corrugated cardboard, paperboard, and/or other materials). In one embodiment, the insert 13 can be formed from a different material than the blank 3. For example, the material of the insert 13 could be uncoated, unprinted paperboard, and the material of the blank 3 could be a paperboard that is coated and/or printed on at least one side. The material of the insert 13 and the material of the blank 3 could be other suitable materials without departing from the disclosure. Additionally, the material of the insert 13 and the material of the blank 3 could be the same material without departing from the disclosure.

As shown in FIG. 2, the insert 13 includes a first panel 81, a second panel 83, and an intermediate portion or intermediate panel 85 between the first panel 81 and the second panel 83. The first panel 81 can be foldably connected to the intermediate portion 85 along a fold line 87, and the second panel 83 can be foldably connected to the intermediate portion 85 along a fold line 89. In one embodiment, the intermediate panel 85 can include a plurality of fold lines 91 extending laterally along the insert 13 (e.g., parallel to the fold lines 87, 89) to at least partially define a plurality of sections 92 that are movable relative to one another. The fold line 87 may be a fold line of the plurality of fold lines 91. As shown, the plurality of fold lines 91 may extend substantially along the entire length of the insert 13, or, in other embodiments, may extend along less than the entire length of the insert 13. As also shown, each fold line 91 may be provided as a continuously extending lateral fold line, or, in other embodiments, one or more of the fold lines 91 may be provided with one or more discontinuities. The insert 13 could be otherwise shaped, arranged, positioned, and/or configured, without departing from the disclosure.

Figure 3:
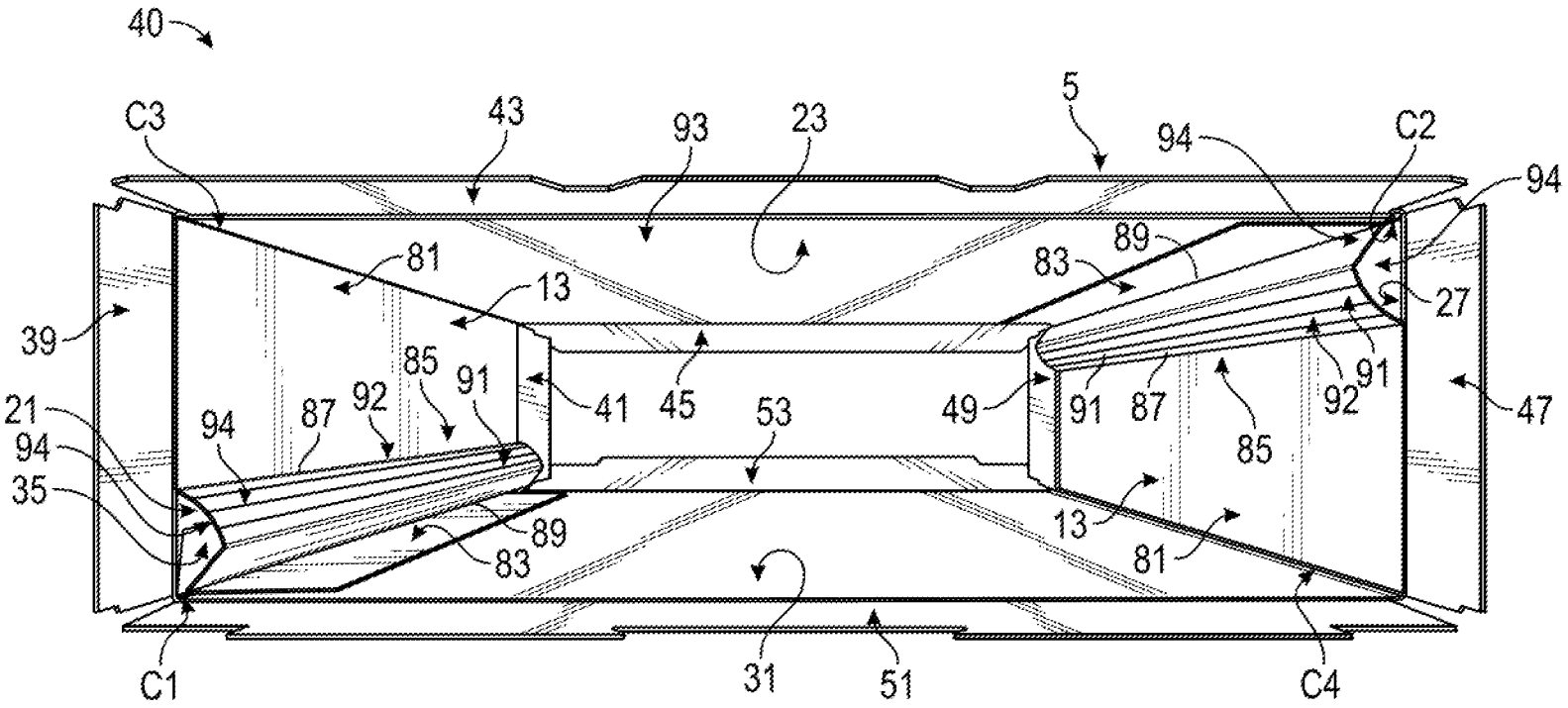
FIG. 3 is a perspective view of two inserts of FIG. 2 disposed in a partially erected carton formed from the blank of FIG. 1 according to the first exemplary embodiment of the disclosure.

Referring to FIG. 1 and FIG. 3, according to one exemplary method of construction, an open-ended sleeve 40 may be erected by folding the blank 3 about the lateral fold lines 25, 29, 33, 37 so that the attachment flap 35 is adhesively secured to or otherwise attached to the first end panel 21 (e.g., by an adhesive), and the blank 3 is formed into a generally open-ended sleeve 40 with an interior 93. As described herein, the sleeve 40 is an open-ended configuration of the carton 5 (FIG. 4), and the interior 93 of the sleeve 40 will form the interior 93 of the carton 5. In the illustrated embodiment, two inserts 13 can be attached to the blank 3 or, as shown in FIG. 3, to the interior 89 of the sleeve 40 (the partially erected carton 5). In one embodiment, the first panels 81 of the respective inserts 13 can be attached (e.g., adhered such as by gluing) to the respective end panels 21, 27 and the second panels 83 of the respective inserts 13 can be attached (e.g., glued) to the respective side panels 31, 23 so that the intermediate portions 85 extend in opposite corners C1, C2 of the sleeve 40. In the illustrated embodiment, the plurality of sections 92 of the respective intermediate portions 85 are free from direct attachment to the panels 31, 27, 23, 21 and the attachment flap 35, e.g., devoid of foldable or adhesive connection to the panels 31, 27, 23, 21, and can fold along fold lines 87, 89, 91 to extend into the interior 93 of the sleeve 40 at the respective corners C1, C2 of the sleeve 40. As described herein, the corners C1, C2, C3, C4 of the sleeve 40 will form corners of the carton 5

(FIG. 4). In this regard, and as illustrated, the plurality of sections 92 of the intermediate portion 85 together form respective protrusions 94 that extend away from the respective corners C1, C2 into the interior 89 of the sleeve 40. The protrusions 94, as shown, may have an at least partially curved or arched configuration. In embodiments, the respective first panels 81 and second panels 83 of the respective inserts 13 may be disposed in relation to one another to urge the respective protrusions 94 into the curved or arched configuration shown. In embodiments, the inserts 13 may be disposed along different portions of the sleeve 40, such that the protrusions 94 are disposed near different opposing corners C3, C4 of the sleeve 40. In embodiments, a single insert 13 or more than two inserts 13 may be provided in the sleeve 40, for example, such that protrusions 94 are disposed along all four corners C1, C2, C3, C4 of the sleeve 40. The inserts 13 could be otherwise attached to the blank 3 and/or the sleeve 40 without departing from the disclosure.

In one embodiment, the open bottom end of the sleeve 40 can be closed by folding the bottom flaps 41, 45, 49, 53 inwardly, to at least partially overlap the bottom end flaps 41, 45, 49, 53 and close the bottom end 9 of the carton 5 (FIG. 4). Similarly, the open top end of the sleeve 40 can be closed by folding and at least partially overlapping the top flaps 39, 43, 47, 51. In one embodiment, the overlapped bottom flaps 41, 45, 49, 53 can be at least partially glued together and/or the overlapped top flaps 39, 43, 47, 51 can be at least partially glued together. In other embodiments, two or more of the bottom flaps 41, 45, 49, 53 and/or two or more of the top flaps 39, 43, 47, 51 can be interengaged (e.g., in a tab- and slot configuration) to close the open top end and/or the open bottom end of the sleeve 40 to form the carton 5. The erected carton 5 is shown in FIG. 4 as part of the package 15. The carton 5 could be otherwise formed without departing from the disclosure.

Referring to FIGS. 1 and 4, in one embodiment, the inserts 13 may have a height H1 that generally the same as a height H2 of the carton 5 (e.g., the inserts 13 can extend substantially along the length from the closed bottom end 9 of the carton 5 to the closed top end 7 of the carton 5). Accordingly, the inserts 13 can reinforce the carton 5 at least for increased compression strength (e.g., to provide resistive forces R against compressive forces F exerted against the top end 7 and/or the bottom end 9 of the carton 5). In embodiments, the presence of the inserts 13 in the carton 5 can provide resistive forces against bending or crushing along lateral portions of the carton 5, e.g., resistance against compressive forces exerted against one or more of panels 31, 27, 23, 21. Such resistance against compression, bending, and/or crushing of portions of the carton 5 is provided by the configuration of the protrusions 94 of the inserts 13. For example, the curved configuration of the protrusions 94 may have a higher area moment of inertia as compared to the square corners C1, C2 of the carton 5 such that increased strength of the carton 5, e.g., resistance against compression, bending, and/or crushing, is provided by the inserts 13. Such configuration of the carton 5 can, for example, allow for direct stacking of multiple packages 15 and/or for allow for use of a lighter material for carton 5. Accordingly, in one embodiment, packages 15 can be stacked upon one another, for example, on a pallet or other storage or transportation medium without requiring reinforcement, for example, corrugated outers as in conventional cartons. In one embodiment, the clearance provided by the inwardly extending protrusions 94 of the inserts 13 can assist in maintaining a desired shape of the package 15, for example, to help avoid unwanted bulging and/or cracking of the inserts 13 and/or the carton 5. In addition, the inserts 13 can be configured and positioned to accommodate product filling in the interior 93 of the carton 15, for example, to reduce empty space, to influence a desired distribution of product, or to avoid interfering with product filling into the carton 5.

In an alternative embodiment, one of the inserts 13 could be incorporated into the blank 3 (FIG. 1) and the carton 5. For example, the second panel 83 of the insert 13 could be omitted and the intermediate portion 85 of the insert 13 could be foldably connected to the second side panel 31 at the fold line 37 in place of the attachment flap 35. In such a configuration, the first panel 81 of the insert 13 could be glued to the first end panel 21 to form an open-ended sleeve with the intermediate portion 85 of the insert 13 forming a protrusion that can extend into the interior 93 of the carton 5 in a configuration similar to that shown in FIG. 4.

Figure 5:
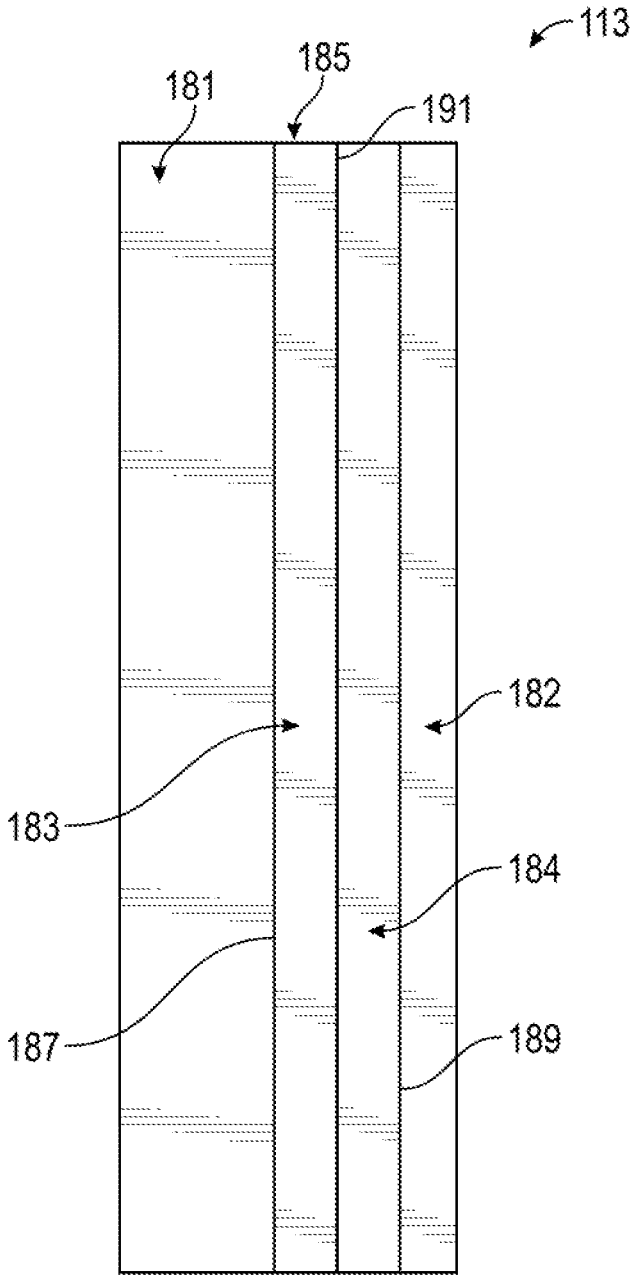
FIG. 5 is a plan view of an insert for being disposed in the carton formed from the blank of FIG. 1 to form a package according to a second exemplary embodiment of the disclosure.

FIG. 5 is a plan view of an insert 113 for use with the carton 5 (FIG. 7) to form a package 115 according to a second exemplary embodiment of the disclosure. The second embodiment is generally similar to the first embodiment, except for variations noted and variations that will be apparent to one of ordinary skill in the art. Accordingly, similar or identical features of the embodiments have been given like or similar reference numbers. As shown in FIG. 5, the insert 113 can include a first panel 181, a second panel 182, a third panel 183, and a fourth panel 184. The first panel 181 can be foldably connected to the third panel 183 along a fold line 187, the second panel 182 can be foldably connected to the fourth panel 184 along a fold line 189, and the third panel 183 can be foldably connected to the fourth panel 184 along a fold line 191. In one embodiment, the third and fourth panels 183, 184 form an intermediate portion 185 of the insert 113. The insert 113 could be otherwise shaped, arranged, positioned, and/or configured, without departing from the disclosure.

Figure 6:
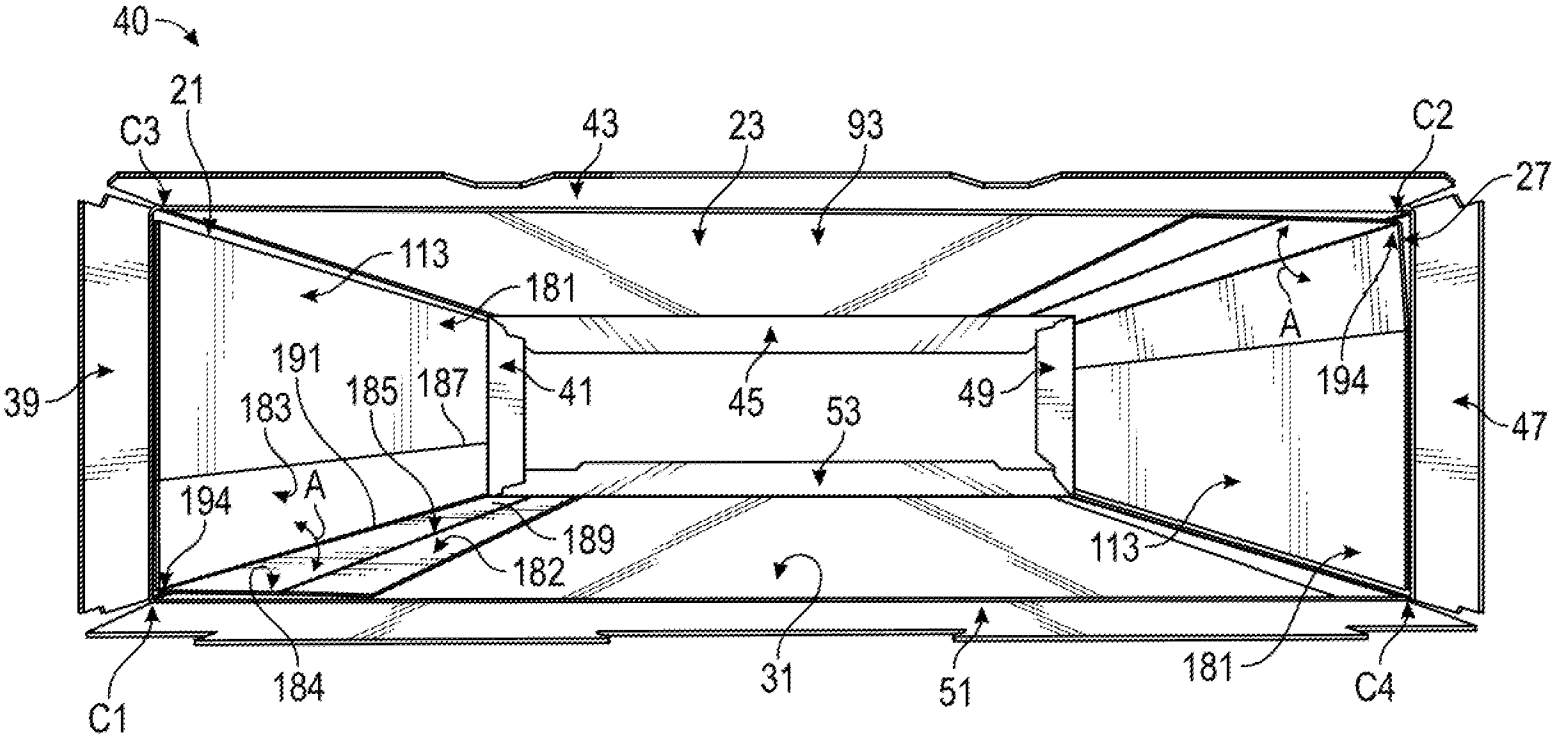
FIG. 6 is a perspective view of two inserts of FIG. 5 disposed in a partially erected carton formed from the blank of FIG. 1 according to the second exemplary embodiment of the disclosure.

As shown in FIG. 6, the inserts 113 can be attached to the blank 3 (FIG. 1) and/or to the sleeve 40 folded from the blank 3 to be disposed along opposite corners C1, C2 of the interior 93 of the sleeve 40. In one embodiment, the first panels 181 of the inserts 113 can be attached (e.g., adhered) to respective end panels 27, 21 of the carton 5, and the second panels 183 of the inserts 113 can be attached to respective side panels 31, 23 of the sleeve 40 so that the inserts 113 are disposed in opposite corners C1, C2 of the sleeve 40. As shown, the third panel 183, and/or the fourth panel 184, e.g., the intermediate portion 185, can be free from direct attachment to the panels 31, 27, 23, 21 such that the panels 183, 184 can be at least partially spaced from the corners C1, C2 into the interior 93 of the sleeve 40 to provide a protrusion 194 into the interior 93 of the sleeve 40. As shown, the protrusions 194 may have an obtuse, angled configuration, e.g., having an angle A between respective panels 183, 184 that is greater than 90 degrees, relative to the adjacent corners C1, C2. In embodiments, the inserts 113 may be disposed along different portions of the sleeve 40, such that the protrusions 194 are disposed near different opposing corners C3, C4 of the sleeve 40. In embodiments, a single insert 113 may be provided in the sleeve 40 or more than two inserts 113 may be provided in the sleeve 40, for example, such that protrusions 194 are disposed along all four corners C1, C2, C3, C4 of the sleeve 40. The inserts 113 could be otherwise attached to the blank 3 and/or the sleeve 40 without departing from the disclosure.

Figure 7:
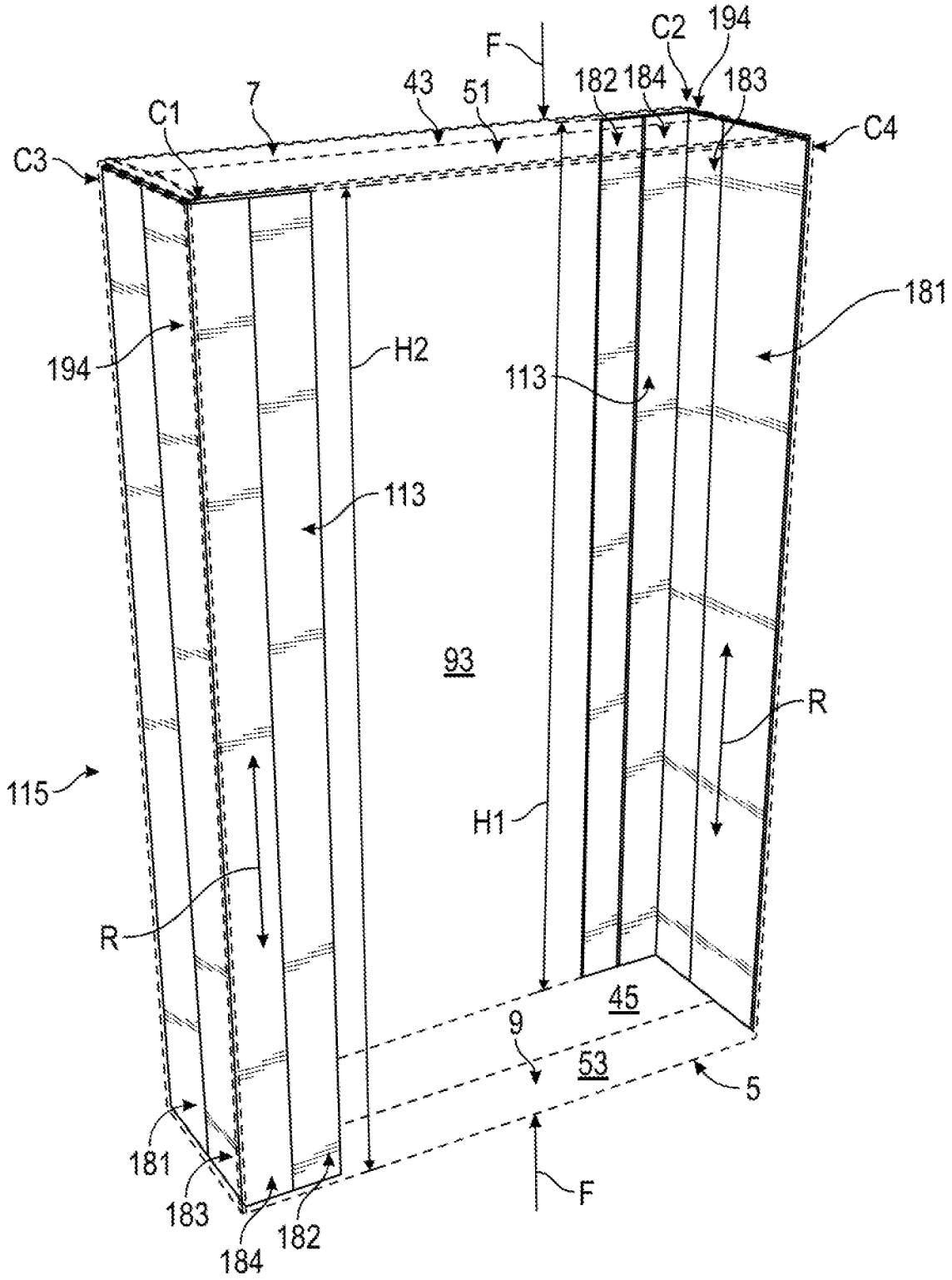
FIG. 7 is a perspective view, shown partially in hidden lines, of the package according to the second exemplary embodiment of the disclosure.

Referring additionally to FIG. 7, the sleeve 40 can be closed into the carton 5 as described above such that the inserts 113 disposed within the carton 5 form the package 115. In one embodiment, the inserts 113 may have a height H1 that generally the same as a height H2 of the carton 5 (e.g., the inserts 113 can extend substantially along the length from the closed bottom end 9 of the carton 5 to the closed top end 7 of the carton 5). Accordingly, the inserts 113 can reinforce the carton 5 at least for increased compression strength (e.g., resistance against compressive forces exerted against the top end 7 and/or the bottom end 9 of the carton 5). In embodiments, the presence of the inserts 113 in the carton 5 can provide resistance against bending or crushing along lateral portions of the carton 5, e.g., resistance against forces F exerted against panels 31, 27, 23, 21. Such resistance against compression, bending, and/or crushing of portions of the carton 5 is provided by the configuration of the protrusions 194 of the inserts 113. For example, the diagonally-disposed configuration of the protrusions 194 with respect to the corners C1, C2 may have provide a higher area moment of inertia as compared to the square corners C1, C2 alone such that increased strength of the carton 5, e.g., resistance against compression, bending, and/or crushing, is provided by the inserts 113. Such configuration of the carton 5 can, for example, allow for direct stacking of multiple packages 115 and/or for allow for use of a lighter material for carton 5. Accordingly, in one embodiment, multiple packages 115 can be stacked upon one another, for example, on a pallet or other storage or transportation medium without requiring reinforcement, for example, corrugated outers as in conventional cartons. In one embodiment, the clearance provided by the inwardly extending intermediate portions 185 of the inserts 113 can assist in maintaining a desired shape of the package 115, for example, to help avoid unwanted bulging and/or cracking of the inserts 113 and/or the carton 5. In addition, the inserts 113 can be configured and positioned to accommodate product filling in the interior 93 of the package 115, for example, to reduce empty space, to influence a desired distribution of product, or to avoid interfering with product filling into the package 115.

Figure 8:
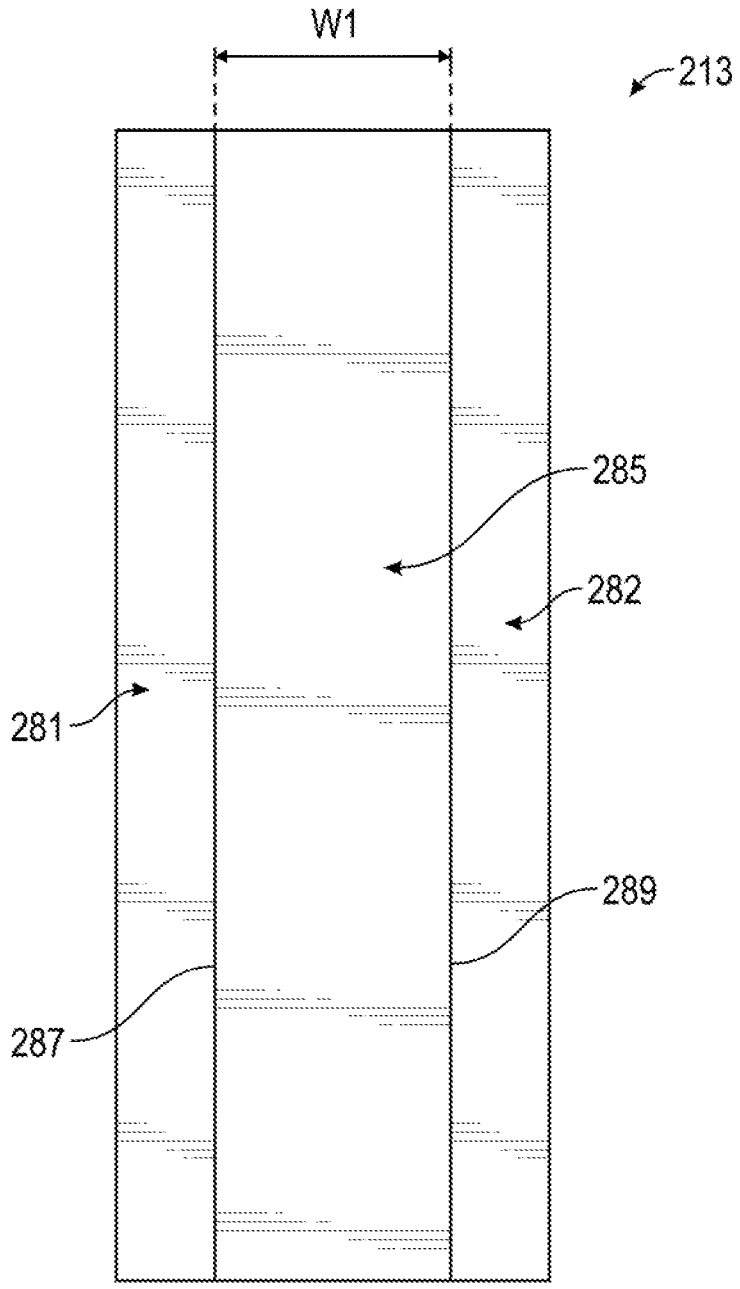
FIG. 8 is a plan view of an insert for being disposed in the carton formed from the blank of FIG. 1 to form a package according to a third exemplary embodiment of the disclosure.

FIG. 8 is a plan view of an insert 213 for use with carton 5 (FIG. 10) to form a package 215 of a third exemplary embodiment of the disclosure. The third embodiment is generally similar to the previous embodiments, except for variations noted and variations that will be apparent to one of ordinary skill in the art. Accordingly, similar or identical features of the embodiments have been given like or similar reference numbers. As shown in FIG. 8, the insert 213 includes a first panel 281, a second panel 282, and an intermediate panel 285. The first panel 281 and the second panel 282 each are foldably connected to the intermediate panel 285 along respective fold lines 287, 289. In the illustrated embodiment, the intermediate panel 285 has a width W1 that is generally the same as a width W2 of the end panels 21, 27 of the carton 5 (FIG. 10).

Figure 9:
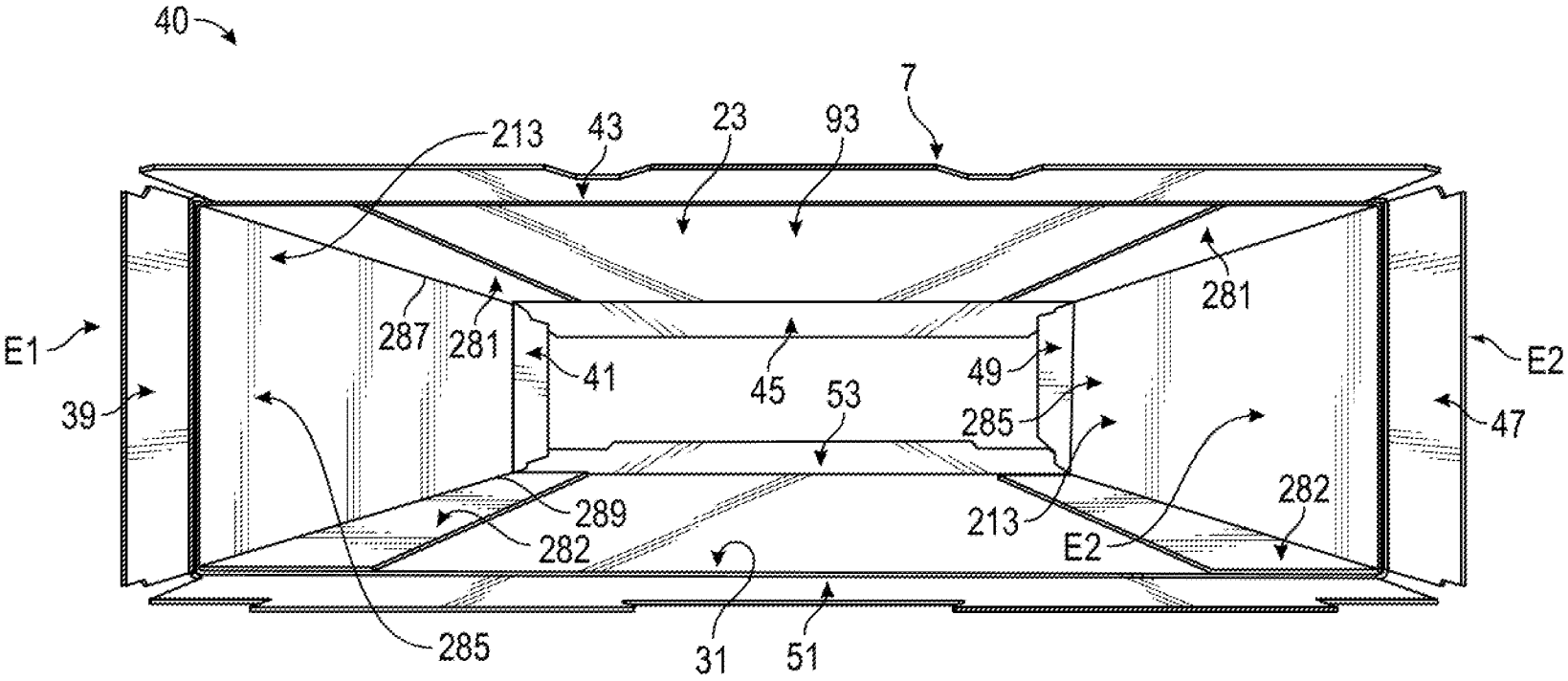
FIG. 9 is a perspective view of two inserts of FIG. 5 disposed in a partially erected carton formed from the blank of FIG. 1 according to the third exemplary embodiment of the disclosure.

As shown in FIG. 9, the first and second panels 281, 282 of the inserts 213 can be attached to the blank 3 (FIG. 1) and/or to the sleeve 40 folded from the blank 3 at the respective side panels 23, 31 at opposite ends E1, E1 of the sleeve 40 (e.g., the intermediate panels 285 of the two inserts 213 can be disposed adjacent the respective end panels 21, 27 of the carton 5 (FIG. 10)). In one embodiment, the intermediate panels 285 are free from direct attachment, e.g., are not glued, to the respective end panels 21, 27 such that the intermediate panels 285 can be movable relative to the respective end panels 21, 27, for example, to provide clearance for folding of the carton 5 and the insert 213. In this regard, the intermediate panels 285 can be in planar relation with the respective end panels 21, 27. The insert 213 could be otherwise shaped, arranged, positioned, and/or configured, without departing from the disclosure. Additionally, the inserts 213 could be otherwise attached to the sleeve 40 and/or could be used with a different sleeve or carton without departing from the disclosure.

Figure 10:
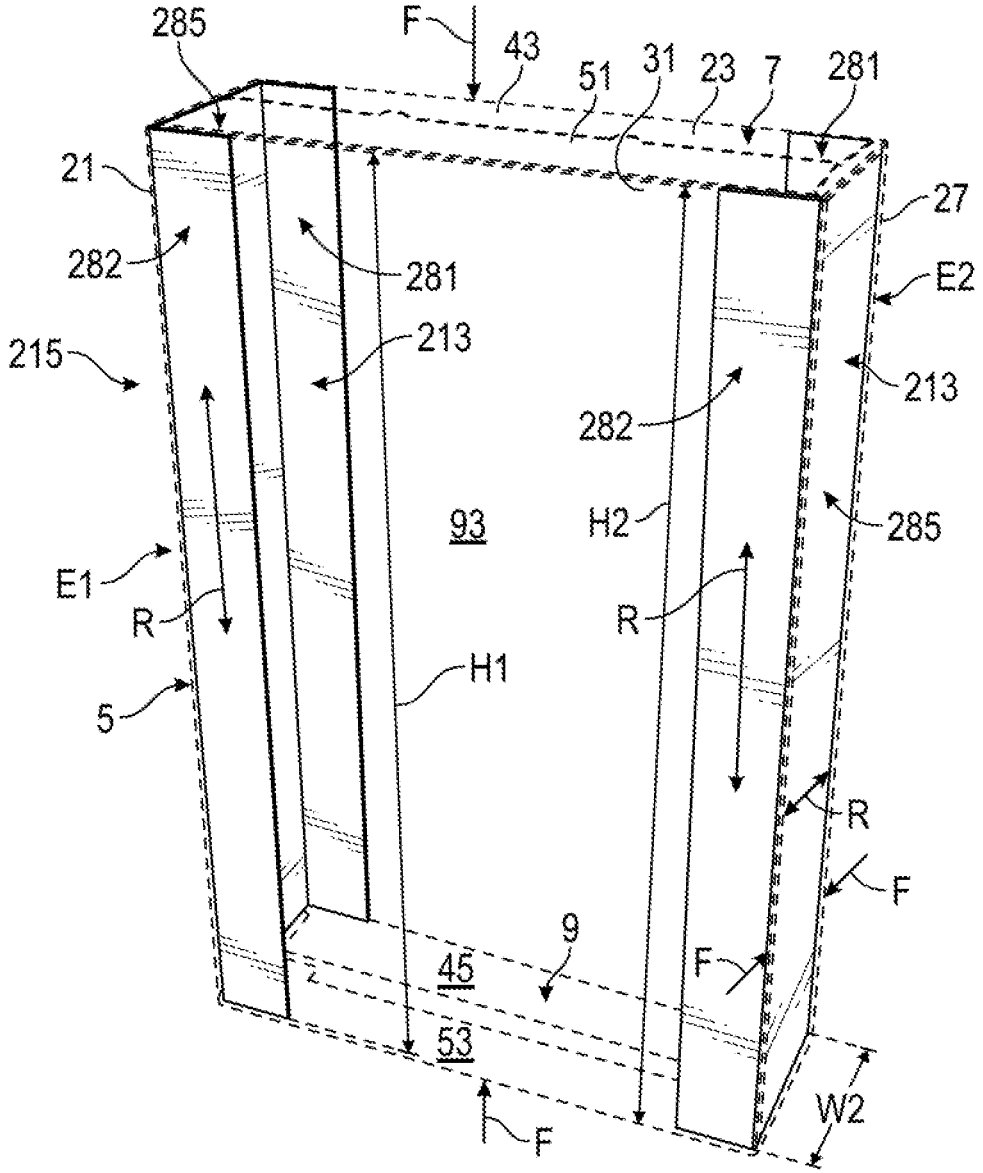
FIG. 10 is a perspective view, shown partially in hidden lines, of the package according to the third exemplary embodiment of the disclosure.

Referring additionally to FIG. 10, the sleeve 40 can be closed into the carton 5 as described above such that the inserts 213 disposed within the carton 5 form the package 215. In one embodiment, the inserts 213 may have height H1 that is generally the same as the height H2 of the carton 5 (e.g., the inserts 213 can extend substantially along the length from the closed bottom end 9 of the carton 5 to the closed top end 7 of the carton 5). Accordingly, the inserts 213 can reinforce the carton 5 at least for increased compression strength (e.g., resistance against compressive forces exerted against the top end 7 and/or the bottom end 9 of the carton 5). In embodiments, the presence of the inserts 213 in the carton 5 can provide resistance against bending or crushing along lateral portions of the carton 5, e.g., resistance against forces F exerted against panels 31, 27, 23, 21. Such resistance provided by the inserts 213 may resist forces F applied axially on the carton 5 or transversely, e.g., against the first and second side panels 31, 23, such that the inserts 213 provide resistance for the carton 5 against deformation caused by squeezing or grabbing by a user. Such resistance against compression, bending, and/or crushing of portions of the carton 5 is provided by the construction of the insert 213, including, for example, the arrangement of the panels 281, 282, 285, the thickness of the material that forms the insert 213, and the mass per unit area (e.g., grammage or basis weight) of the material that forms the insert 213. In this regard, the amount of force that the carton 5 can resist can be selected by a user by adjusting one or more of the above parameters of the insert 213 to suit the particular needs of the package 215.

Such configuration of the insert 213 and the carton 5 can, for example, allow for direct stacking of multiple packages 215 and/or for allow for use of a lighter material for carton 5. Accordingly, in one embodiment, multiple packages 215 can be stacked upon one another, for example, on a pallet or other storage or transportation medium without requiring reinforcement, for example, corrugated outers as in conventional cartons. In one embodiment, the clearance provided by the inwardly extending intermediate portions 285 of the inserts 213 can assist in maintaining a desired shape of the package 215, for example, to help avoid unwanted bulging and/or cracking of the inserts 213 and/or the carton 5. In addition, the inserts 213 can be configured and positioned to accommodate product filling in the interior 93 of the package 215, for example, to reduce empty space, to influence a desired distribution of product, or to avoid interfering with product filling into the package 215.

Figure 11:
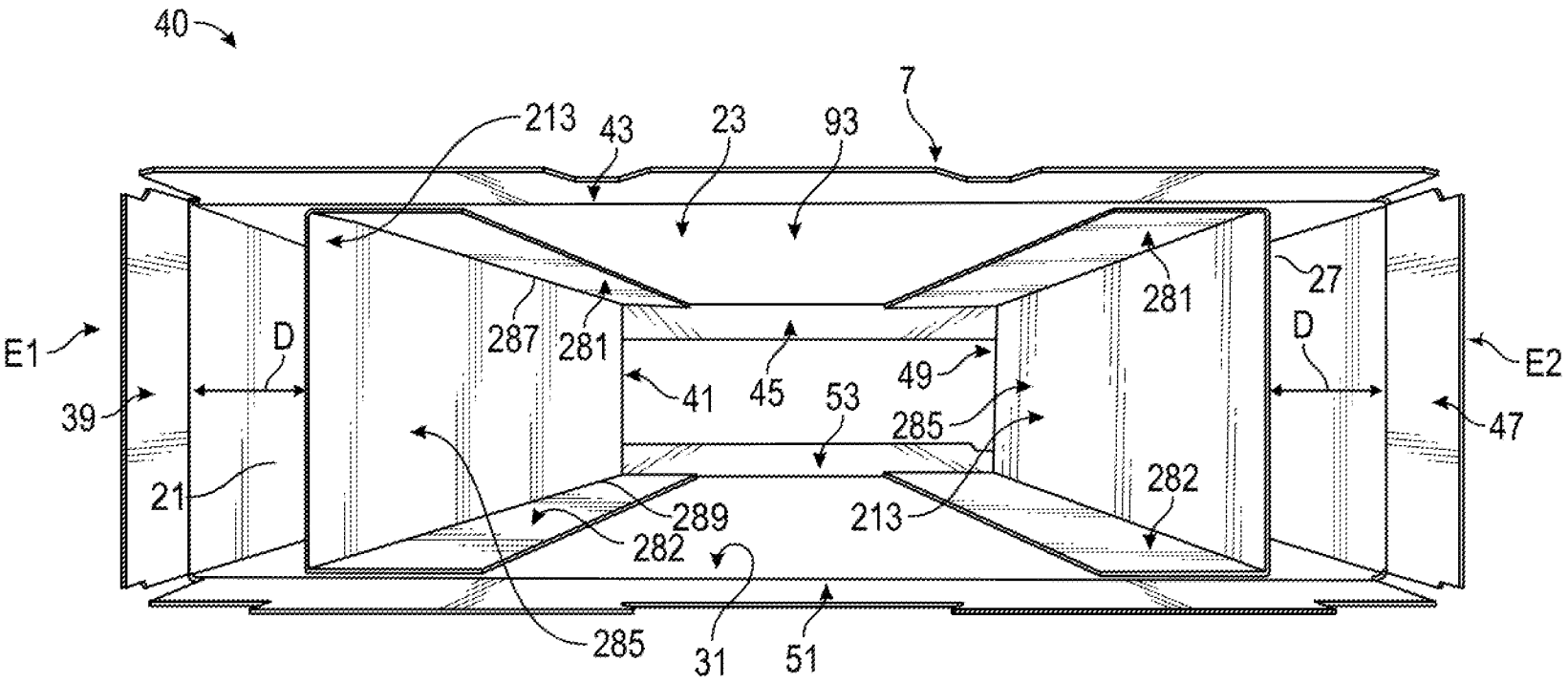
FIG. 11 is a perspective view of two inserts of FIG. 5 disposed in a partially erected carton formed from the blank of FIG. 1 according to the third exemplary embodiment of the disclosure in an alternative arrangement.
Figure 12:
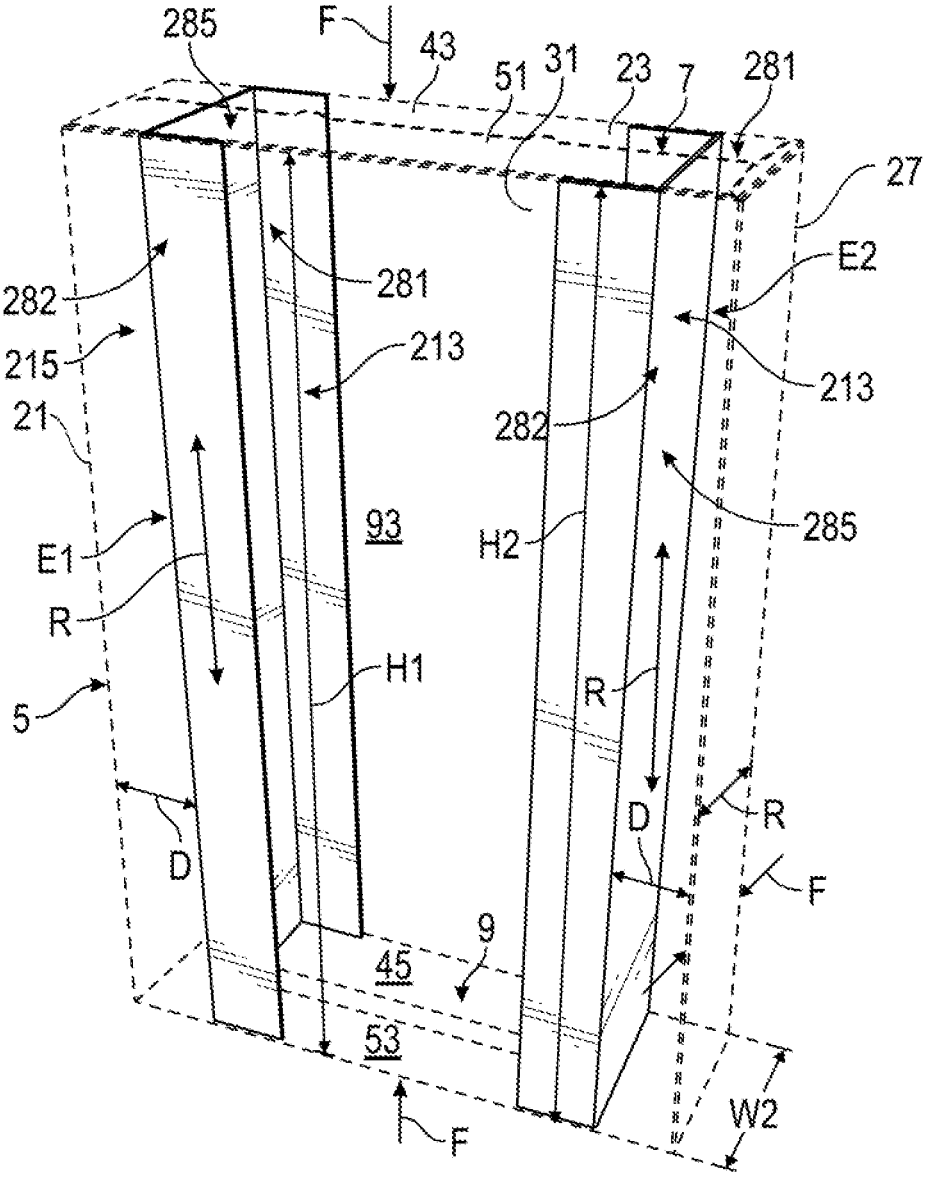
FIG. 12 is a perspective view, shown partially in hidden lines, of the package according to the third exemplary embodiment of the disclosure in an alternative arrangement.

Turning to FIGS. 11 and 12, the inserts 213 can be positioned further into the interior 93 of the sleeve 40 and the package 215 such that the intermediate panels 285 are spaced a distance D from the respective end panels 27, 21. The distance D can be selected such that an available volume within the interior 93 for accommodating a product in a desired arrangement. For example, the inserts 213 can be arranged such that a product within the interior 93 of the package 215 is constrained such that the product redistributes vertically along the height H2 of the carton 5. Such constraint and redistribution of a product in the interior 93 of the carton 5 due to the arrangement of the inserts 213 can prevent outward bulging of the product against the side panels 31, 23 of the carton 5. While the inserts 213 have been shown spaced an equal distance D from the respective end panels 27, 21, in embodiments, the inserts 213 may be spaced different distances from the respective end panels 27, 21.

Different insert configurations may be provided to form different package configurations without departing from the disclosure. For example, inserts may be provided with a greater or fewer number of foldably-connected panels than those described, and different numbers of inserts may be provided than those described, without departing from the disclosure. In embodiments, inserts may be provided as integrally forming (e.g., foldably connected) along a portion of blanks for forming cartons without departing from the disclosure.

Any of the features of the various embodiments of the disclosure can be combined with, replaced by, or otherwise configured with other features of other embodiments of the disclosure without departing from the scope of this disclosure. Further, the panels, flaps, and/or other features shown and described in conjunction with the blanks, the cartons, and/or the packages of the above embodiments are included by way of example. The inserts and/or other features of the disclosure can alternatively be associated with any suitable carton or blank having any panel and flap configuration.

The cartons according to the present disclosure can be, for example, formed from blanks of coated paperboard and similar materials. For example, the interior and/or exterior sides of the blanks can be coated with a clay coating. The clay coating may then be printed over with product, advertising, price coding, and other information or images. The blanks may then be coated with a varnish to protect any information printed on the blank. The blanks may also be coated with, for example, a moisture barrier layer, on either or both sides of the blank. In accordance with the above-described embodiments, the blanks may be constructed of paperboard of a caliper such that it is heavier and more rigid than ordinary paper. The blanks can also be constructed of other materials, such as cardboard, hard paper, or any other material having properties suitable for enabling the carton to function at least generally as described herein. The blanks can also be laminated or coated with one or more sheet-like materials at selected panels or panel sections.

In accordance with the above-described embodiments of the present disclosure, a fold line can be any substantially linear, although not necessarily straight, form of weakening that facilitates folding therealong. More specifically, but not for the purpose of narrowing the scope of the present disclosure, fold lines include: a score line, such as lines formed with a blunt scoring knife, or the like, which creates a crushed portion in the material along the desired line of weakness; a cut that extends partially into a material along the desired line of weakness, and/or a series of cuts that extend partially into and/or completely through the material along the desired line of weakness; and various combinations of these features.

As an example, a tear line can include: a slit that extends partially into the material along the desired line of weakness, and/or a series of spaced apart slits that extend partially into and/or completely through the material along the desired line of weakness, or various combinations of these features. As a more specific example, one type tear line is in the form of a series of spaced apart slits that extend completely through the material, with adjacent slits being spaced apart slightly so that a nick (e.g., a small somewhat bridging-like piece of the material) is defined between the adjacent slits for typically temporarily connecting the material across the tear line. The nicks are broken during tearing along the tear line. The nicks typically are a relatively small percentage of the tear line, and alternatively the nicks can be omitted from or torn in a tear line such that the tear line is a continuous cut line. That is, it is within the scope of the present disclosure for each of the tear lines to be replaced with a continuous slit, or the like. For example, a cut line can be a continuous slit or could be wider than a slit without departing from the present disclosure.

The above embodiments may be described as having one or more panels, flaps, or features, adhered together by glue during erection of the carton embodiments. The term "glue" is intended to encompass all manner of adhesives commonly used to secure carton panels in place.

The foregoing description of the disclosure illustrates and describes various embodiments. As various changes could be made in the above construction without departing from the scope of the disclosure, it is intended that all matter contained in the above description or shown in the accompanying drawings shall be interpreted as illustrative and not in a limiting sense. Furthermore, the scope of the present disclosure covers various modifications, combinations, alterations, etc., of the above-described embodiments that are within the scope of the claims. Additionally, the disclosure shows and describes only selected embodiments of the disclosure, but the disclosure is capable of use in various other combinations, modifications, and environments and is capable of changes or modifications within the scope of the inventive concept as expressed herein, commensurate with the above teachings, and/or within the skill or knowledge of the relevant art. Furthermore, certain features and characteristics of each embodiment may be selectively interchanged and applied to other illustrated and non-illustrated embodiments of the disclosure.

What is claimed is:

1. A package for holding at least one product, comprising:

a carton comprising a plurality of panels extending at least partially around an interior of the carton, the plurality of panels forming at least one corner of the carton; and at least one insert at least partially disposed in the interior of the carton adjacent the at least one corner to reinforce the carton, the at least one insert comprising a first panel comprising a free edge, a second panel comprising a free edge, and an intermediate portion foldably connected to each of the first panel and the second panel, the intermediate portion is foldably connected to the first panel at a first fold line and the intermediate portion is foldably connected to the second panel at a second fold line, the first fold line is spaced apart from the free edge of the first panel and the second fold line is spaced apart from the free edge of the second panel, the intermediate portion has an at least partially curved configuration, each of the first panel and the second panel is in at least partial face-to-face contact with a respective panel of the plurality of panels and the intermediate portion is free from attachment to the plurality of panels.

2. The package of claim 1, wherein the at least one insert is devoid of foldable connection to the plurality of panels.

3. The package of claim 1, wherein the intermediate portion is spaced from the at least one corner.

4. The package of claim 3, wherein the intermediate portion forms a protrusion extending into the interior of the carton.

5. The package of claim 4, wherein the protrusion has the at least partially curved configuration.

6. The package of claim 3, wherein the intermediate portion has a moment of inertia that is greater than a moment of inertia of the at least one corner.

7. The package of claim 1, wherein the intermediate portion comprises a plurality of sections defined by a respective plurality of fold lines, each section of the plurality of sections is movable relative to an adjacent section of the plurality of sections.

8. The package of claim 1, wherein the at least one insert has a length that is substantially the same as a length of the carton.

9. The package of claim 1, wherein the at least one corner comprises a first corner and a second corner, and the at least one insert comprises a first insert having a respective intermediate portion spanning the first corner and a second insert having a respective intermediate portion spanning the second corner.

10. The package of claim 9, wherein the first corner and the second corner are diagonally opposed across the interior of the carton.

11. In combination, a carton blank and at least one insert blank for forming a package for holding at least one product, comprising:

the carton blank for forming a carton and comprising a plurality of panels for extending at least partially around an interior of the carton, the plurality of panels for forming at least one corner of the carton when the carton is formed from the carton blank; and the at least one insert blank for forming at least one insert for being at least partially disposed in the interior of the carton adjacent the at least one corner to reinforce the carton when the package is formed, the at least one insert blank comprising a first panel comprising a free edge, a second panel comprising a free edge, and an intermediate portion foldably connected to each of the first panel and the second panel, the intermediate portion is foldably connected to the first panel at a first fold line and the intermediate portion is foldably connected to the second panel at a second fold line, the first fold line is spaced apart from the free edge of the first panel and the second fold line is spaced apart from the free edge of the second panel, the intermediate portion has an at least partially curved configuration when the package is formed, each of the first panel and the second panel is for being positioned in at least partial face-to-face contact with a respective panel of the plurality of panels and the intermediate portion is for being free from attachment to the plurality of panels when the package is formed.

12. The combination of claim 11, wherein the at least one insert blank is devoid of foldable connection to the plurality of panels.

13. The combination of claim 11, wherein the intermediate portion is spaced from the at least one corner when the package is formed.

14. The combination of claim 13, wherein the intermediate portion forms a protrusion extending into the interior of the carton when the package is formed.

15. The combination of claim 14, wherein the protrusion has the at least partially curved configuration.

16. The combination of claim 13, wherein the intermediate portion has a moment of inertia that is greater than a moment of inertia of the at least one corner when the package is formed.

17. The combination of claim 11, wherein the intermediate portion comprises a plurality of sections defined by a respective plurality of fold lines, each section of the plurality of sections is movable relative to an adjacent section of the plurality of sections.

18. The combination of claim 11, wherein the at least one insert has a length that is substantially the same as a length of the carton when the carton is formed.

19. The combination of claim 11, wherein the at least one corner comprises a first corner and a second corner when the carton is formed, and the at least one insert blank comprises a first insert blank having a respective intermediate portion spanning the first corner and a second insert blank having a respective intermediate portion spanning the second corner when the package is formed.

20. The combination of claim 19, wherein the first corner and the second corner are diagonally opposed across the interior of the carton when the carton is formed.

21. A method of forming a package from a carton blank and at least one insert blank, comprising:

obtaining a carton blank comprising a plurality of panels;

obtaining at least one insert blank comprising a first panel comprising a free edge, a second panel comprising a free edge, and an intermediate portion foldably connected to each of the first panel and the second panel, the intermediate portion is foldably connected to the first panel at a first fold line and the intermediate portion is foldably connected to the second panel at a second fold line, the first fold line is spaced apart from the free edge of the first panel and the second fold line is spaced apart from the free edge of the second panel;

forming the at least one insert by attaching the at least one insert blank to the carton blank;

forming the carton by folding the plurality of panels of the carton blank to extend at least partially around an interior of the carton and forming at least one corner of the carton; and disposing the at least one insert at least partially in the interior of the carton adjacent the at least one corner such that each of the first panel and the second panel is in at least partial face-to-face contact with a respective panel of the plurality of panels and the intermediate portion has an at least partially curved configuration and is free from attachment to the plurality of panels.

22. The method of claim 21, wherein the at least one insert is devoid of foldable connection to the plurality of panels when the at least one insert is at least partially disposed in the interior of the carton.

23. The method of claim 21, wherein the intermediate portion is spaced from the at least one corner.

24. The method of claim 23, wherein the intermediate portion forms a protrusion extending into the interior of the carton when the at least one insert is at least partially disposed in the interior of the carton.

25. The method of claim 24, wherein the protrusion has the at least partially curved configuration.

26. The method of claim 23, wherein the intermediate portion has a moment of inertia that is greater than a moment of inertia of the at least one corner when the at least one insert is at least partially disposed in the interior of the carton.

27. The method of claim 21, wherein the at least one insert has a length that is substantially the same as a length of the carton when the carton is formed.

28. The method of claim 21, wherein the at least one corner comprises a first corner and a second corner when the carton is formed, and the at least one insert comprises a first insert having a respective intermediate portion spanning the first corner and a second insert having a respective intermediate portion spanning the second corner when the at least one insert is at least partially disposed in the interior of the carton.

29. The method of claim 28, wherein the first corner and the second corner are diagonally opposed across the interior of the carton when the carton is formed.

30. A package for holding at least one product, comprising:

a carton comprising a plurality of panels extending at least partially around an interior of the carton, the plurality of panels forming at least one end of the carton; and at least one insert at least partially disposed in the interior of the carton adjacent the at least one end to reinforce the carton, the at least one insert comprising a first panel comprising a free edge, a second panel comprising a free edge, and an intermediate portion foldably connected to each of the first panel and the second panel, the intermediate portion is foldably connected to the first panel at a first fold line and the intermediate portion is foldably connected to the second panel at a second fold line, the first fold line is spaced apart from the free edge of the first panel and the second fold line is spaced apart from the free edge of the second panel, the intermediate portion is disposed in planar relation to a panel of the plurality of panels, each of the first panel and the second panel is in at least partial face-to-face contact with a respective panel of the plurality of panels and the intermediate portion is free from attachment to the plurality of panels.

31. The package of claim 30, wherein the at least one end is a first end and the plurality of panels forms a second end of the carton, and wherein the at least one insert is a first insert having an intermediate portion extending across the first end of the carton and the package further comprises a second insert having an intermediate portion extending across the second end of the carton.

32. The package of claim 31, wherein the intermediate portion of the respective first insert and second insert are spaced a respective distance away from the respective first end and second end of the carton.

33. In combination, a carton blank and at least one insert blank for forming a package for holding at least one product, comprising:

the carton blank for forming a carton and comprising a plurality of panels for extending at least partially around an interior of the carton, the plurality of panels for forming at least one end of the carton when the carton is formed from the carton blank; and the at least one insert blank for forming at least one insert for being at least partially disposed in the interior of the carton adjacent the at least one end to reinforce the carton when the package is formed, the at least one insert blank comprising a first panel comprising a free edge, a second panel comprising a free edge, and an intermediate portion foldably connected to each of the first panel and the second panel, the intermediate portion is foldably connected to the first panel at a first fold line and the intermediate portion is foldably connected to the second panel at a second fold line, the first fold line is spaced apart from the free edge of the first panel and the second fold line is spaced apart from the free edge of the second panel, the intermediate portion is disposed in planar relation to a panel of the plurality of panels when the package is formed, each of the first panel and the second panel is for being positioned in at least partial face-to-face contact with a respective panel of the plurality of panels and the intermediate portion is for being free from attachment to the plurality of panels when the package is formed.

34. The combination of claim 33, wherein the at least one end is a first end of the carton and the plurality of panels forms a second end of the carton when the carton is formed, and wherein the at least one insert blank is a first insert blank having an intermediate portion extending across the first end of the carton and the at least one insert blank comprises a second insert blank having an intermediate portion extending across the second end of the carton when the package is formed.

35. The combination of claim 34, wherein the intermediate portion of the respective first insert and second insert are spaced a respective distance away from the respective first end and second end of the carton when the carton is formed.

36. A method of forming a package from a carton blank and at least one insert blank, comprising:

obtaining a carton blank comprising a plurality of panels;

obtaining at least one insert blank comprising a first panel comprising a free edge, a second panel comprising a free edge, and an intermediate portion foldably connected to each of the first panel and the second panel, the intermediate portion is foldably connected to the first panel at a first fold line and the intermediate portion is foldably connected to the second panel at a second fold line, the first fold line is spaced apart from the free edge of the first panel and the second fold line is spaced apart from the free edge of the second panel;

forming the at least one insert by attaching the at least one insert blank to the carton blank;

forming the carton by folding the plurality of panels of the carton blank to extend at least partially around an interior of the carton and forming at least one end of the carton; and disposing the at least one insert at least partially in the interior of the carton adjacent the at least one end such that each of the first panel and the second panel is in at least partial face-to-face contact with a respective panel of the plurality of panels and the intermediate portion is disposed in planar relation to a panel of the plurality of panels and is free from attachment to the plurality of panels.

37. The method of claim 36, wherein the at least one end is a first end of the carton and the plurality of panels forms a second end of the carton when the carton is formed, and wherein the at least one insert is a first insert having an intermediate portion extending across the first end of the carton and the at least one insert comprises a second insert having an intermediate portion extending across the second end of the carton.

38. The method of claim 37, wherein the intermediate portion of the respective first insert and second insert are spaced a respective distance away from the respective first end and second end of the carton.

* * * * *